US009188077B2

(12) United States Patent
Kojima

(10) Patent No.: US 9,188,077 B2
(45) Date of Patent: Nov. 17, 2015

(54) FUEL INJECTION CONTROL SYSTEM FOR INTERNAL COMBUSTION ENGINE

(75) Inventor: Susumu Kojima, Susono (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 146 days.

(21) Appl. No.: 14/129,194

(22) PCT Filed: Jul. 1, 2011

(86) PCT No.: PCT/JP2011/065224
§ 371 (c)(1),
(2), (4) Date: Dec. 24, 2013

(87) PCT Pub. No.: WO2013/005284
PCT Pub. Date: Jan. 10, 2013

(65) Prior Publication Data
US 2014/0123955 A1 May 8, 2014

(51) Int. Cl.
*F02D 41/30* (2006.01)
*F02M 37/00* (2006.01)
*F02D 41/38* (2006.01)
*F02M 59/36* (2006.01)

(52) U.S. Cl.
CPC ..... *F02D 41/30* (2013.01); *F02D 41/3845* (2013.01); *F02D 41/3854* (2013.01); *F02M 37/0047* (2013.01); *F02M 37/0041* (2013.01); *F02M 59/366* (2013.01)

(58) Field of Classification Search
CPC .. F02D 41/30; F02D 41/3845; F02M 37/0047
See application file for complete search history.

(56) References Cited

U.S. PATENT DOCUMENTS

2001/0023684 A1* 9/2001 Demura et al. ..... 123/457
2011/0162622 A1 7/2011 Kojima et al.
2013/0138327 A1 5/2013 Kojima

FOREIGN PATENT DOCUMENTS

JP 2003-222060 A 8/2003
JP 2009-221906 A 10/2009
JP 2010-071224 A 4/2010
WO 2012056534 A1 5/2012

* cited by examiner

*Primary Examiner* — Lindsay Low
*Assistant Examiner* — Kevin Lathers
(74) *Attorney, Agent, or Firm* — Sughrue Mion, PLLC

(57) ABSTRACT

A fuel injection control system for an internal combustion engine in which a driving signal for a high pressure fuel pump is calculated by using proportional plus integral control based on a difference between a delivery pressure of the high pressure fuel pump and a target pressure thereof. A delivery pressure of a low pressure fuel pump is caused to decrease when an amount of change per unit time of an integral term shows a decreasing tendency or zero, whereas the delivery pressure of the low pressure fuel pump is caused to increase when the amount of change per unit time of the integral term shows an increasing tendency. In cases where an increase in the integral term resulting from a change in the target delivery pressure of the high pressure fuel pump has occurred, the increase in the delivery pressure of the low pressure fuel pump is prohibited.

2 Claims, 3 Drawing Sheets

FUEL INJECTION CONTROL SYSTEM FOR INTERNAL COMBUSTION ENGINE

CROSS REFERENCE TO RELATED APPLICATIONS

This application is a National Stage of International Application No. PCT/JP2011/065224 filed Jul. 1, 2011, the contents of all of which are incorporated herein by reference in their entirety.

TECHNICAL FIELD

The present invention relates to a fuel injection control system for an internal combustion engine provided with a low pressure fuel pump (feed pump) and a high pressure fuel pump (supply pump).

BACKGROUND ART

In internal combustion engines of the type in which fuel is directly injected into each cylinder, there has been known a fuel injection control system which is provided with a low pressure fuel pump that serves to draw up fuel from a fuel tank, and a high pressure fuel pump that serves to cause the fuel thus drawn up by the low pressure fuel pump to rise up to a pressure at which the fuel can be injected into each cylinder.

In the fuel injection control system as mentioned above, in order to suppress the energy consumption accompanying the operation of the low pressure fuel pump, it is desired to decrease the delivery pressure (feed pressure) of the low pressure fuel pump as much as possible.

In a first patent document, there is described a technique in which in a system to regulate the delivery pressure of a high pressure fuel pump by means of a pre-controlled amount as well as an amount of open control and an amount of closed loop control, the delivery pressure of a low pressure fuel pump is caused to decrease, in cases where an output of an integrator, to which the amount of open control and the amount of closed loop control are supplied, becomes zero.

In a second patent document, there is described a technique of adjusting the delivery pressure of a low pressure fuel pump in accordance with an amount of driving of a pressure control valve or a relief valve of a high pressure fuel pump.

In a third patent document, there is described a technique in which in cases where the driving duty of a high pressure fuel pump becomes equal to or greater than a predetermined value, a determination is made that vapor has been generated, thus causing feed pressure to go up.

PRIOR ART DOCUMENTS

Patent Documents

Patent Document 1: Japanese Patent Application Laid-Open No. 2003-222060

Patent Document 2: Japanese Patent Application Laid-Open No. 2009-221906

Patent Document 3: Japanese Patent Application Laid-Open No. 2010-071224

DISCLOSURE OF THE INVENTION

Problem To Be Solved By The Invention

However, in the system described in the above-mentioned Patent Document 1, in cases where a target pressure of the high pressure fuel pump changes, etc., the value of the integrator may become larger than zero. In other words, even in cases where cavitation (vapor) of fuel has not been generated, the value of the integrator may become larger than zero. As a result, even though the cavitation of fuel has not been generated, there may occur a situation in which the delivery pressure of the low pressure fuel pump is not caused to decrease.

The present invention has been made in view of the above-mentioned actual circumstances, and the object of the invention is that in a fuel injection control system for an internal combustion engine provided with a low pressure fuel pump and a high pressure fuel pump, the delivery pressure of the low pressure fuel pump is caused to decrease as much as possible, while avoiding vaporization of fuel.

Means For Solving The Problem

In order to solve the above-mentioned problems, the present invention resides in a fuel injection control system for an internal combustion engine in which a driving signal for a high pressure fuel pump is calculated by making use of proportional plus integral control (PI control) based on a difference between a delivery pressure of the high pressure fuel pump and a target pressure thereof, and a delivery pressure of a low pressure fuel pump is caused to decrease when an amount of change per unit time of an integral term (I term) shows a decreasing tendency or zero, whereas the delivery pressure of the low pressure fuel pump is caused to increase when the amount of change per unit time of the integral term shows an increasing tendency, wherein in cases where an increase in the integral term resulting from a change of the target delivery pressure of the high pressure fuel pump has occurred, the increase in the delivery pressure of the low pressure fuel pump is prohibited.

Specifically, the present invention resides in a fuel injection control system for an internal combustion engine in which fuel delivered from a low pressure fuel pump is pressurized by a high pressure fuel pump and is supplied to a fuel injection valve, wherein said system is provided with:

a pressure sensor that detects a delivery pressure of said high pressure fuel pump;

an arithmetic operation unit that calculates a driving signal for said high pressure fuel pump by using a proportional term and an integral term which are calculated with the use of a deviation between a target delivery pressure of said high pressure fuel pump and a detected value of said pressure sensor as a parameter;

a first processing unit that carries out decreasing processing for decreasing the delivery pressure of said low pressure fuel pump when an amount of change per unit time of said integral term is equal to or less than zero;

a second processing unit that carries out increasing processing for increasing the delivery pressure of said low pressure fuel pump when the amount of change per unit time of said integral term is larger than zero; and a prohibition unit that prohibits execution of the increasing processing by said second processing unit when said integral term shows an increasing tendency due to a change in the target delivery pressure of said high pressure fuel pump.

In cases where the driving signal for the high pressure fuel pump is calculated by making use of the proportional plus integral control which uses, as a parameter, a deviation between the target delivery pressure of the high pressure fuel pump and the detected value of the pressure sensor (hereinafter referred to as an "actual delivery pressure"), and in cases where the delivery pressure of said low pressure fuel pump is decreased continuously or in a stepwise manner, when vapor is generated in a fuel path extending from the low pressure fuel pump to the high pressure fuel pump, said integral term shows the increasing tendency (i.e., the amount of change per unit time of said integral term becomes larger than zero). Accordingly, when said decreasing processing is carried out in cases where said integral term shows a constant or decreasing tendency (i.e., in cases where the amount of change per unit time of said integral term becomes equal to or less than zero), and when said increasing processing is carried out in cases where said integral term shows the increasing tendency (i.e., in cases where the amount of change per unit time of said integral term becomes larger than zero), it is possible to decrease the delivery pressure of the low pressure fuel pump, while avoiding the generation of vapor.

However, in cases where the target delivery pressure of the high pressure fuel pump increases, the deviation between the target delivery pressure and the actual delivery pressure of the high pressure fuel pump becomes large. That is, in cases where the target delivery pressure of the high pressure fuel pump increases, the target delivery pressure becomes higher with respect to the actual delivery pressure. When the target delivery pressure becomes larger with respect to the actual delivery pressure, said integral term shows the increasing tendency, though vapor has not been generated in said fuel path. In such a case, when said increasing processing is carried out, the driving force of the low pressure fuel pump becomes unnecessarily large.

On the other hand, the fuel injection control system of the present invention prohibits the execution of said decreasing processing, in cases where said integral term shows the increasing tendency in accompany with the change in the target delivery pressure of the high pressure fuel pump. For example, in cases where an amount of increase per unit time of the target delivery pressure of the high pressure fuel pump exceeds a threshold value, said prohibition unit may prohibit the execution of said increasing processing. Stated in another way, if the amount of increase per unit time of the target delivery pressure of the high pressure fuel pump is larger than the threshold value at the time when the amount of change per unit time of said integral term becomes larger than zero, said prohibition unit may prohibit the execution of said increasing processing.

When the execution of said increasing processing is prohibited in this manner, it is possible to avoid a situation in which the delivery pressure of the low pressure fuel pump is caused to go up, though no vapor is generated in said fuel path. As a result, according to the fuel injection control system for an internal combustion engine of the present invention, the delivery pressure of the low pressure fuel pump can be decreased as much as possible, while avoiding the generation of vapor of fuel.

Here, note that in cases where the target delivery pressure of the high pressure fuel pump decreases, too, the deviation between the target delivery pressure and the actual delivery pressure of the high pressure fuel pump becomes large. However, in cases where the target delivery pressure of the high pressure fuel pump decreases, the target delivery pressure becomes smaller with respect to the actual delivery pressure, as a result of which said integral term shows the decreasing tendency. At that time, when the fuel pressure in said fuel path has already become close to a saturated vapor pressure of the fuel, there will be a possibility that by the execution of said decreasing processing, the fuel pressure in said fuel path may be excessively decreased, thus inducing the generation of vapor.

Accordingly, the prohibition unit according to the present invention may prohibit said decreasing processing, when the amount of change per unit time of said integral term becomes equal to or less than zero in accompany with the change in the target delivery pressure of said high pressure fuel pump. For example, in cases where an amount of decrease per unit time of the target delivery pressure of the high pressure fuel pump exceeds a threshold value, said prohibition unit may prohibit the execution of said decreasing processing. Stated in another way, if the amount of decrease per unit time of the target delivery pressure of the high pressure fuel pump is larger than the threshold value at the time when the amount of change per unit time of said integral term becomes equal to or less than zero, said prohibition unit may prohibit the execution of said decreasing processing.

When the execution of said decreasing processing is prohibited in this manner, it is possible to avoid a situation in which the delivery pressure of the low pressure fuel pump is caused to further go down, though the fuel pressure in said fuel path is sufficiently low. In other words, it is possible to avoid a situation in which vapor is generated in said fuel path due to an excessive decrease in the delivery pressure of the low pressure fuel pump.

Effects Of The Invention

According to the present invention, in a fuel injection control system for an internal combustion engine provided with a low pressure fuel pump and a high pressure fuel pump, the delivery pressure of the low pressure fuel pump can be decreased as much as possible, while avoiding the generation of vapor of fuel.

THE BEST MODE FOR CARRYING OUT THE INVENTION

In the following, specific embodiments of the present invention will be described with reference to the drawings. The dimensions, materials, shapes and relative arrangements etc. of the components that will be described in connection with the embodiments are not intended to limit the technical scope of the present invention only to them, unless particularly stated.

Figure 1:
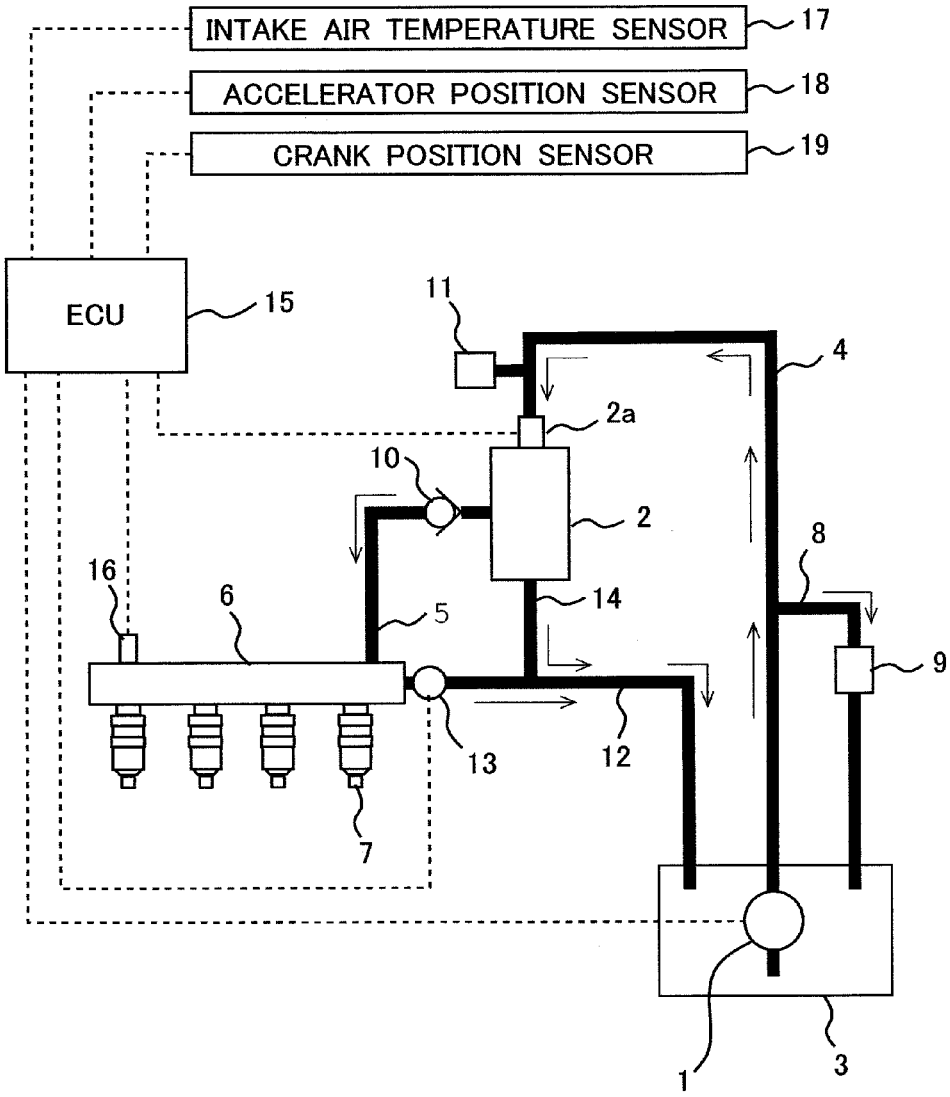
FIG. 1 is a view showing the schematic construction of a fuel injection system for an internal combustion engine to which the present invention is applied.

FIG. 1 is a view showing the schematic construction of a fuel injection control system for an internal combustion engine according to the present invention. The fuel injection control system shown in FIG. 1 is one applied to an internal combustion engine having in-line four cylinders, and is provided with a low pressure fuel pump 1 and a high pressure fuel pump 2. Here, note that the number of cylinders of the internal combustion engine is not limited to four, but may be five or more, and alternatively may be three or less.

The low pressure fuel pump 1 is a pump for pumping or drawing up fuel stored in a fuel tank 3, and is a turbine type pump (WESCO type pump) which is driven by electric power. It is constructed such that the fuel delivered from the low pressure fuel pump 1 is led to a suction port of the high pressure fuel pump 2 through a low pressure fuel passage 4.

The high pressure fuel pump 2 is a pump for pressurizing the fuel delivered from the low pressure fuel pump 1, and is a reciprocating type pump (e.g., plunger type pump) which is driven by the power of the internal combustion engine (e.g., a rotating force of a cam shaft). A suction valve 2*a* for changing over between opening and closure of the suction port is disposed in the suction port of the high pressure fuel pump 2. The suction valve 2*a* is a valve mechanism of an electromagnetic drive type, and changes an amount of discharge or delivery of the high pressure fuel pump 2 by changing the opening and closing timing thereof with respect to the position of a plunger. In addition, a high pressure fuel passage 5 has a base and thereof connected to a delivery port of the high pressure fuel pump 2. The high pressure fuel passage 5 has a terminal end thereof connected to a delivery pipe 6.

Four fuel injection valves 7 are connected to the delivery pipe 6, so that the high pressure fuel pressure fed from the high pressure fuel pump 2 to the delivery pipe 6 is distributed to each of the fuel injection valves 7. Each of the fuel injection valves 7 is a valve mechanism which serves to inject fuel directly into a corresponding cylinder of the internal combustion engine.

Here, note that in cases where fuel injection valves for port injection for injecting fuel to the interiors of intake passages (intake ports), respectively, are mounted on the internal combustion engine, in addition to the fuel injection valves for cylinder injection such as the above-mentioned fuel injection valves 7, it may be constructed such that fuel of low pressure is supplied to delivery pipes for port injection which are branched from the middle of the low pressure fuel passage 4.

A pulsation damper 11 is disposed in the middle of the above-mentioned low pressure fuel passage 4. The pulsation damper 11 is to damp the pulsation of fuel resulting from the operation (suction operation and delivery operation) of the above-mentioned high pressure fuel pump 2. In addition, a branch passage 8 has a base end thereof connected to the middle of the above-mentioned low pressure fuel passage 4. The terminal end of the branch passage 8 has a terminal end thereof connected to the fuel tank 3. A pressure regulator 9 is disposal in the middle of the branch passage 8. The pressure regulator 9 is constructed such that it is opened at the time when the pressure (fuel pressure) in the low pressure fuel passage 4 exceeds a predetermined value, whereby surplus fuel in the low pressure fuel passage 4 returns to the fuel tank 3 through the branch passage 8.

A check valve 10 is disposed in the middle of the above-mentioned high pressure fuel passage 5. The check valve 10 is a one-way valve which permits a flow going to the above-mentioned delivery pipe 6 from the delivery port of the above-mentioned high pressure fuel pump 2, but restricts a flow going to the delivery port of the above-mentioned high pressure fuel pump 2 from the above-mentioned delivery pipe 6.

A return passage 12 for returning the surplus fuel in the above-mentioned delivery pipe 6 to the above-mentioned fuel tank 3 is connected to the delivery pipe 6. In the middle of the return passage 12, a relief valve 13 valve is disposed which serves to change over between communication and blocking of the return passage 12. The relief valve 13 is a valve mechanism of an electromotive type or an electromagnetic drive type, and is opened when the fuel pressure in the delivery pipe 6 exceeds a target value.

A communication passage 14 has a terminal end connected to the middle of the above-mentioned return passage 12. The communication passage 14 has a base end connected to the above-mentioned high pressure fuel pump 2. This communication passage 14 is a passage for introducing the surplus fuel discharged from the high pressure fuel pump 2 to the return passage 12.

Here, the fuel supply system in this embodiment is provided with an ECU 15 for electrically controlling the individual above-mentioned equipment. The ECU 15 is an electronic control unit which includes a CPU, a ROM, a RAM, a backup RAM, and so on. The ECU 15 is electrically connected to a variety of kinds of sensors such as a fuel pressure sensor 16, an intake air temperature sensor 17, an accelerator position sensor 18, a crank position sensor 19, and so on.

The fuel pressure sensor 16 is a sensor which outputs an electrical signal correlated with the fuel pressure (the delivery pressure of the high pressure fuel pump) Ph in the delivery pipe 6. The intake air temperature sensor 17 outputs an electrical signal correlated with the temperature of air sucked into the internal combustion engine. The accelerator position sensor 18 outputs an electrical signal correlated with an amount of operation of an accelerator pedal (i.e., a degree of opening of an accelerator). The crank position sensor 19 is a sensor which outputs an electrical signal correlated with the rotational position of an output shaft (crankshaft) of the internal combustion engine.

The ECU 15 controls the low pressure fuel pump 1, the suction valve 2*a*, etc., based on the output signals of the above-mentioned variety of kinds of sensors. For example, the ECU 15 regulates the opening and closing timing of the suction valve 2*a* so that an output signal (actual delivery pressure) Ph of the fuel pressure sensor 16 is converged to a target delivery pressure Phtrg. At that time, the ECU 15 carries out feedback control of a driving duty (a ratio between the time of energization and the time of non-energization of a solenoid) Dh, which is a controlled amount (variable) of the suction valve 2*a*, based on a difference ΔPh (=Phtrg−Ph) between an actual delivery pressure Ph and the target delivery pressure Phtrg. Specifically, the ECU 15 carries out proportional plus integral control (PI control) on the driving duty Dh of the suction valve 2*a* based on the difference ΔPhto. Here, note that the above-mentioned target delivery pressure Phtrg is a value which is set in accordance with a target amount of fuel injection of each fuel injection valve 7.

In the above-mentioned proportional plus integral control, the ECU 15 calculates the driving duty Dh by adding a controlled variable (feed forward term) Tff which is decided according to the target amount of fuel injection, a controlled variable (proportional term) Tp which is decided according to the magnitude of the difference ΔPh between the actual delivery pressure Ph and the target delivery pressure Phtrg, and a controlled variable (integral term) Ti which is obtained by integrating a part of the difference ΔPh (e.g. a residual deviation (offset) of the proportional control).

Here, note that the relation between the above-mentioned target amount of fuel injection and the feed forward term Tff as well as the relation between the above-mentioned difference ΔPh and the proportional term Tp are assumed to be decided in advance by adaptation operations making use of experiments, etc. In addition, it is also assumed that the proportion of an amount to be added to the integral term Ti, of the above-mentioned difference ΔPh(s), is decided in advance by adaptation operations making use of experimenta, etc.

By calculating the driving duty Dh of the suction valve 2*a* in such a manner by means of the ECU 15, an arithmetic operation unit according to the present invention is achieved.

In addition, the ECU 15 carries out processing of decreasing the delivery pressure (feed pressure) Pl of the low pressure fuel pump 1, in order to reduce the electric power consumption of the low pressure fuel pump 1 as much as possible.

Specifically, the ECU 15 calculates a driving signal Dl for the low pressure fuel pump 1 according to the following expression (1). Here, note that the magnitude of the driving signal Dl is assumed be proportional to the delivery pressure Pl of the low pressure fuel pump 1.

$$Dl=Dlold+\Delta Ti*F-Cdwn \quad (1)$$

Dlold in expression (1) above is the last calculated value of the driving signal Dl. ΔTi in expression (1) is an amount of change ΔTi of the integral term Ti used for the above-mentioned proportional plus integral control (e.g. a difference (Ti−Tiold) between an integral term Ti used for the current calculation operation and an integral term Tiold used for the last calculation operation, of the driving duty Dh). F in expression (1) is a correction coefficient. Here, note that, as the correction coefficient F, an increase coefficient Fi, being equal to or larger than 1, is used when the amount of change ΔTi of the integral term Ti is a positive value, whereas a decrease coefficient Fd, being less than 1, is used when the amount of change ΔTi of the integral term Ti is a negative value. In addition, Cdwn in expression (1) is a decrease constant.

After the driving signal Dl for the low pressure fuel pump 1 is decided according to the above-mentioned expression (1), when the above-mentioned integral term Ti shows an upward or increasing tendency (ΔTi>0), the driving signal Dl for the low pressure fuel pump 1 will increase (i.e., the delivery pressure Pl will go up), whereas when the integral term Ti shows a downward or decreasing tendency or a constant value (ΔTi≤0), the driving signal Dl for the low pressure fuel pump 1 will decrease (the delivery pressure Pl will go down).

Here, the above-mentioned integral term Ti shows the increasing tendency, when vapor has been generated in the low pressure fuel passage 4, or stated in another way, the fuel pressure in the low pressure fuel passage 4 becomes lower than the saturated vapor pressure of the fuel. Here, the behaviors of the integral term Ti and the fuel pressure Ph in the high pressure fuel passage 5 (i.e., the actual delivery pressure of the high pressure fuel pump 2) in the case of continuously decreasing the delivery pressure (feed pressure) Pl of the low pressure fuel pump 1 are shown in FIG. 2.

Figure 2:
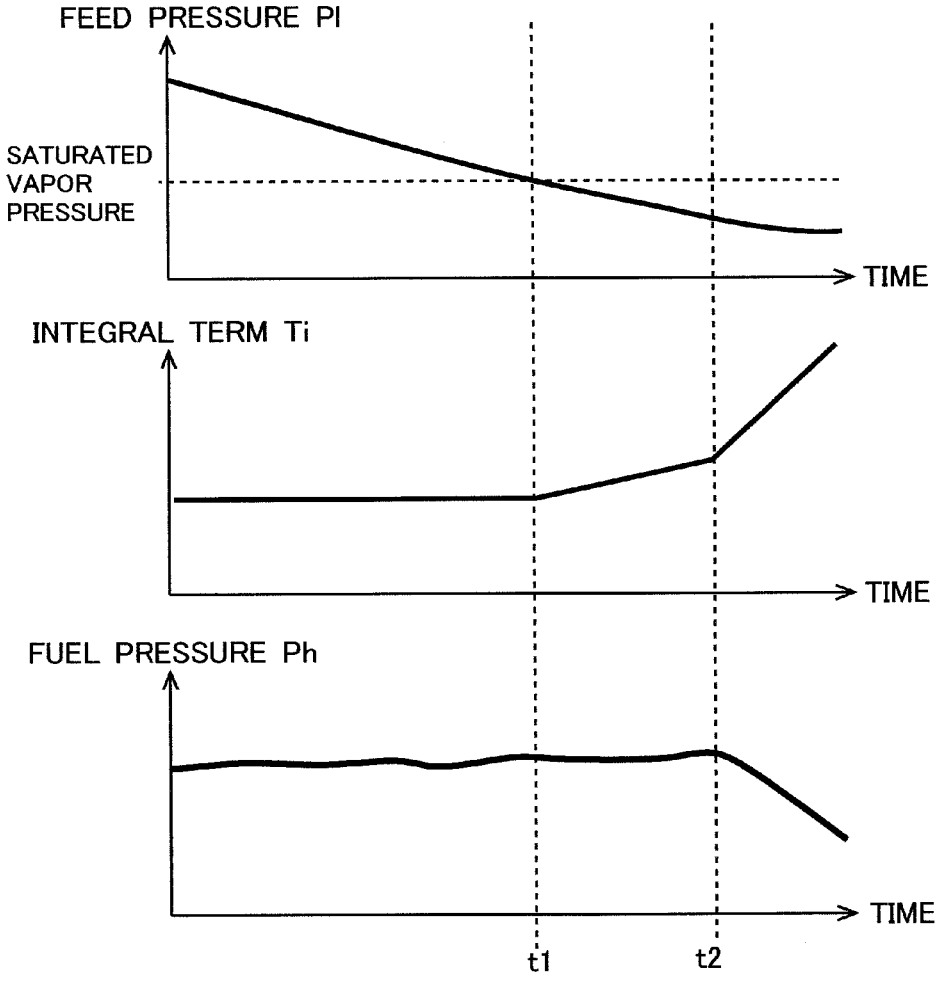
FIG. 2 is a view showing the behavior of an integral term and the behavior of fuel pressure in an interior of a high pressure fuel passage, when the delivery pressure of a low pressure fuel pump is caused to decrease.

In FIG. 2, when the feed pressure Pl becomes lower than the saturated vapor pressure (t1 in FIG. 2), the integral term Ti shows a gradually increasing tendency. After that, when the feed pressure Pl is further decreased, poor suction or poor discharge of the high pressure fuel pump 2 will occur (t2 in FIG. 2). When poor suction or the amount of discharge of the high pressure fuel pump 2 occurs, the increasing speed of the integral term Ti becomes large, and the fuel pressure Ph in the high pressure fuel passage 5 decreases.

Accordingly, in cases where the driving signal Dl for the low pressure fuel pump 1 is decided according to the above-mentioned expression (1), when the above-mentioned integral term Ti shows the increasing tendency (ΔTi>0), the delivery pressure Pl of the low pressure fuel pump 1 goes up, whereas when the integral term Ti shows a constant value or the decreasing tendency (ΔT i≤0), the delivery pressure Pl of the low pressure fuel pump 1 goes down. As a result, it is possible to decrease the delivery pressure Pl of the low pressure fuel pump, while suppressing the poor suction and poor delivery of the high pressure fuel pump 2 resulting from the generation of vapor. Here, note that by the ECU 15 calculating the driving signal Dl for the low pressure fuel pump 1 by making use of the above-mentioned expression (1), a first processing unit and a second processing unit according to the present invention are achieved.

However, the above-mentioned integral term Ti also shows the increasing tendency, in cases where the target delivery pressure Phtrg of the high pressure fuel pump 2 has changed. For example, in cases where the target delivery pressure Phtrg of the high pressure fuel pump 2 increases, the target delivery pressure Phtrg becomes higher than the actual delivery pressure Ph, and the deviation between the target delivery pressure Phtrg and the actual delivery pressure Ph is enlarged, as a result of which the integral term Ti shows the increasing tendency (ΔTi>0). In such a case, when the driving signal Dl for the low pressure fuel pump 1 is calculated according to the above-mentioned expression (1), the delivery pressure Pl of the low pressure fuel pump 1 will be caused to go up, though there will be no vapor generated in the low pressure fuel passage 4. As a result, the electric power consumption of the low pressure fuel pump 1 may increase.

On the other hand, the fuel injection control system of this embodiment is configured to prohibit the calculation processing (i.e., increasing processing) of the driving signal Dl according to the above-mentioned expression (1), in cases where the above-mentioned integral term Ti has indicated the increasing tendency due to an increase in the target delivery pressure Phtrg of the high pressure fuel pump 2 (ΔTi>0). Specifically, the ECU 15 is configured such that if an increased amount ΔPhtrgi of the target delivery pressure Phtrg of the high pressure fuel pump is larger than a threshold value ΔPhith at the time when the amount of change ΔTi of the integral term Ti becomes larger than zero, the calculation processing of the driving signal Dl according to the above-mentioned expression (1) is prohibited. In other words, the ECU 15 is configured to drive the low pressure fuel pump by using the last calculated value Dlold of the driving signal Dl. Here, the threshold value ΔPhith is a minimum amount of increase ΔPhtrgi with which it is considered that an increase in the target delivery pressure Phtrg is reflected on an increase in the integral term Ti under the condition that vapor has not been generated in the low pressure fuel passage 4, and which is a value that has been beforehand obtained by adaptation processing using experiments, etc.

In addition, in cases where the target delivery pressure Phtrg of the high pressure fuel pump 2 decreases, the target delivery pressure Phtrg becomes smaller than the actual delivery pressure Ph, and the deviation between the target delivery pressure Phtrg and the actual delivery pressure Ph is enlarged, as a result of which the integral term Ti shows the decreasing tendency (ΔTi<0). In such a case, if the driving signal Dl for the low pressure fuel pump 1 is calculated according to the above-mentioned expression (1), the delivery pressure Pl of the low pressure fuel pump 1 will be caused to go down, though the fuel pressure in the low pressure fuel passage 4 is sufficiently low. As a result, there will be a possibility that the fuel pressure in the low pressure fuel passage 4 may become excessively low, as compared with the saturated vapor pressure of the fuel.

On the other hand, the fuel injection control system of this embodiment is configured to prohibit the calculation processing (i.e., decreasing processing) of the driving signal Dl according to the above-mentioned expression (1), in cases where the above-mentioned integral term Ti has indicated the decreasing tendency (ΔTi<0) due to a decrease in the target delivery pressure Phtrg of the high pressure fuel pump 2. Specifically, the ECU 15 is configured such that if a decreased amount ΔPhtrgd of the target delivery pressure Phtrg of the high pressure fuel pump is larger than a threshold value ΔPhdth at the time when the amount of change ΔTi of the integral term Ti becomes smaller than zero, the calculation processing of the driving signal Dl according to the above-mentioned expression (1) is prohibited. In other words, the ECU 15 is configured to drive the low pressure fuel pump by using the last calculated value Dlold of the driving signal Dl. Here, the threshold value ΔPhdth is a minimum amount of decrease ΔPhtrgd with which it is considered that a decrease in the target delivery pressure Phtrg is reflected on a decrease in the integral term Ti under the condition that vapor has not been generated in the low pressure fuel passage 4, and which is a value that has been beforehand obtained by adaptation processing using experiments, etc.

Figure 3:
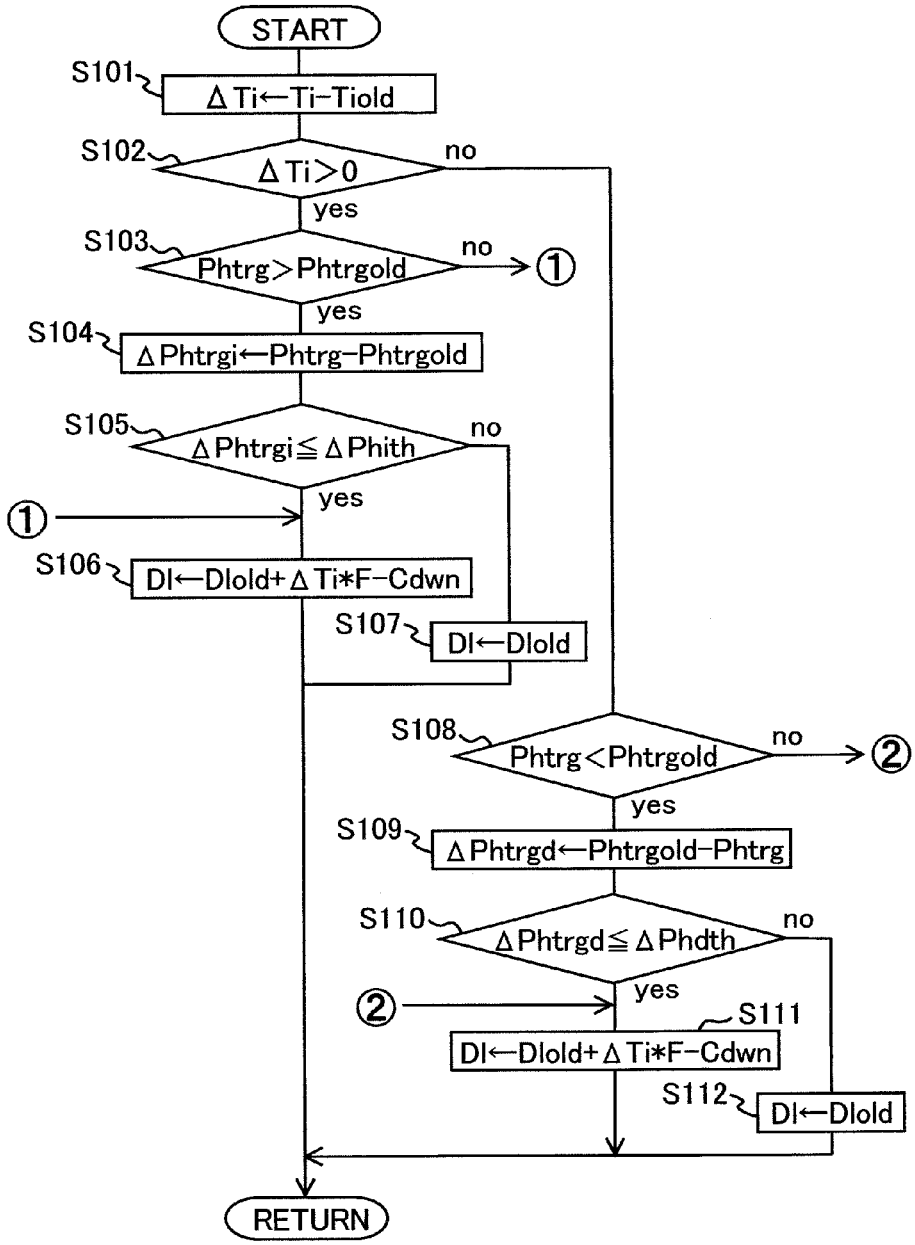
FIG. 3 is a flow chart showing a control routine which is executed at the time when the delivery pressure (driving signal) of the low pressure fuel pump is decided.

Hereinafter, a control procedure of the low pressure fuel pump 1 in this embodiment will be described in line with FIG. 3. FIG. 3 is a flow chart showing a control routine which the ECU 15 carries out at the time of deciding the driving signal Dl for the low pressure fuel pump 1. This control routine has been beforehand stored in the ROM of the ECU 15, and is carried out by the ECU 15 in a periodical manner (at each unit time as mentioned above).

In the control routine of FIG. 3, the ECU 15 first carries out the processing of step S101. That is, the ECU 15 reads in the value of the integral term Ti used at the time of calculating the driving duty Dh of the high pressure fuel pump 2. Subsequently, the ECU 15 calculates the amount of change ΔTi (=Ti−Tiold) of the integral term Ti per unit time by subtracting the last integral term Tiold from the integral term Ti read in the above-mentioned step S101.

In step S102, the ECU 15 determines whether the amount of change ΔTi calculated in the above-mentioned step S101 is larger than zero. In cases where an affirmative determination is made in step S102 (ΔTi>0), the ECU 15 goes to step S103.

In step S103, the ECU 15 determines whether the latest target delivery pressure Phtrg of the high pressure fuel pump 2 is larger than the last target delivery pressure Phtrgold thereof. In cases where an affirmative determination is made in step S103 (Phtrg>Phtrgold), the ECU 7 goes to step S104. On the other hand, in cases where a negative determination is made in step S103 (Phtrg≤Phtrgold), the ECU 15 goes to step S106, while skipping steps S104, S105 which will be described later.

In step S104, the ECU 15 calculates the increased amount ΔPhtrgi (=Phtrg−Phtrgold) of the target delivery pressure per unit time by subtracting the last target delivery pressure Phtrgold from the latest target delivery pressure Phtrg of the high pressure fuel pump 2.

In step S105, the ECU 15 determines whether the increased amount ΔPhtrgi calculated in the above-mentioned step S104 is equal to or less than the threshold value ΔPhith. In cases where an affirmative determination is made in step S105 (ΔPhtrgi≤ΔPhith), the ECU 7 goes to step S106. On the other hand, in cases where a negative determination is made in step S105 (ΔPhtrgi>ΔPhith), the ECU 7 goes to step S107.

In step S106, the ECU 15 calculates the driving signal Dl for the low pressure fuel pump 1 by making use of the amount of change ΔTi calculated in the above-mentioned step S101 and the above-mentioned expression (1). Here, it can be considered that when the increased amount ΔPhtrgi is equal to or less than the threshold value ΔPhith, an increase factor of the integral term Ti resides in the generation of vapor in the low pressure fuel passage 4. Accordingly, when the driving signal Dl for the low pressure fuel pump 1 is calculated based on the above-mentioned amount of change ΔTi and the above-mentioned expression (1), the delivery pressure Pl of the low pressure fuel pump 1 can be caused to go up. As a result, it is possible to make the fuel pressure in the low pressure fuel passage 4 higher than the saturated vapor pressure of the fuel.

In step S107, the ECU 15 sets the last driving signal Dlold as the latest driving signal Dl, without carrying out the calculation processing of the driving signal Dl making use of the amount of change ΔTi calculated in the above-mentioned step S101 and the above-mentioned expression (1). Here, it can be considered that when the increased amount ΔPhtrgi is larger than the threshold value ΔPhith, the increase factor of the integral term Ti resides in the increase in the target delivery pressure Phtrg. Accordingly, when the last driving signal Dlold is set as the latest driving signal Dl, it is possible to avoid a situation in which the delivery pressure Pl of the low pressure fuel pump 1 is caused to go up unnecessarily, though no vapor is generated in the low pressure fuel passage 4.

On the other hand, in cases where a negative determination is made in the above-mentioned step S102 (ΔTi≤0), the ECU 15 goes to step S108. In step S108, the ECU 15 determines whether the latest target delivery pressure Phtrg of the high pressure fuel pump 2 is smaller than the last target delivery pressure Phtrgold. In cases where an affirmative determination is made in step S108 (Phtrg<Phtrgold), the ECU 15 goes to step S109. On the other hand, in cases where a negative determination is made in step S108 (Phtrg≥Phtrgold), the ECU 15 goes to step S111, while skipping steps S109, S110 which will be described later.

In step S109, the ECU 15 calculates the decreased amount ΔPhtrgd (=Phtrgold−Phtrg) of the target delivery pressure per unit time by subtracting the latest target delivery pressure Phtrg from the last target delivery pressure Phtrgold of the high pressure fuel pump 2.

In step S110, the ECU 15 determines whether the decreased amount ΔPhtrgd calculated in the above-mentioned step S109 is equal to or less than the threshold value ΔPhdth. In cases where an affirmative determination is made in step S110 (ΔPhtrgd≤ΔAPhdth), the ECU 15 goes to step S111. On the other hand, in cases where a negative determination is made in step S110 (ΔPhtrgd>ΔPhdth), the ECU 15 goes to step S112.

In step S111, the ECU 15 calculates the driving signal Dl for the low pressure fuel pump 1 by making use of the amount of change ΔTi calculated in the above-mentioned step S101 and the above-mentioned expression (1). Here, it can be considered that when the decreased amount ΔPhtrgd is equal to or less than the threshold value ΔPhdth, a decrease factor of the integral term Ti resides in that the fuel pressure in the low pressure fuel passage 4 is higher than an appropriate pressure. Accordingly, when the driving signal Dl for the low pressure fuel pump 1 is calculated based on the above-mentioned amount of change ΔTi and the above-mentioned expression (1), the delivery pressure Pl of the low pressure fuel pump 1 can be caused to go down. As a result, it is possible to cause the fuel pressure in the low pressure fuel passage 4 to go down.

In step S112, the ECU 15 sets the last driving signal Dlold as the latest driving signal Dl, without carrying out the calculation processing of the driving signal Dl making use of the amount of change ΔTi calculated in the above-mentioned step S101 and the above-mentioned expression (1). Here, it can be considered that when the decreased amount ΔPhtrgd is larger than the threshold value ΔPhdth, the decrease factor of the integral term Ti resides in the decrease in the target delivery pressure Phtrg. Accordingly, when the last driving signal Dlold is set as the latest driving signal Dl, it is possible to avoid a situation in which the delivery pressure Pl of the low pressure fuel pump 1 is caused to go down unnecessarily, though the fuel pressure in the low pressure fuel passage 4 is sufficiently low.

Here, a prohibition unit according to the present invention is achieved by the execution of the processing in the above-mentioned step S107 and the above-mentioned step S112 by means of the ECU 15.

In this manner, by deciding the delivery pressure (the driving signal Dl) of the low pressure fuel pump 1 according to the control routine of FIG. 3 by means of the ECU 15, it is possible to make the delivery pressure Pl of the low pressure fuel pump 1 low as much as possible, while avoiding the generation of vapor in the low pressure fuel passage 4.

DESCRIPTION OF THE REFERENCE NUMERALS AND SYMBOLS

1 low pressure fuel pump
2 high pressure fuel pump
2*a* suction valve
3 fuel tank
4 low pressure fuel passage
5 high pressure fuel passage
6 delivery pipe
7 fuel injection valves
8 branch passage
9 pressure regulator
10 check valve
11 pulsation damper
12 return passage
13 relief valve
14 communication passage
15 ECU
16 fuel pressure sensor
17 intake air temperature sensor
18 accelerator position sensor
19 crank position sensor

The invention claimed is:

1. A fuel injection control system for an internal combustion engine in which fuel delivered from a low pressure fuel pump is pressurized by a high pressure fuel pump and is supplied to a fuel injection valve, said system comprising:

a pressure sensor that detects a delivery pressure of said high pressure fuel pump;

an arithmetic operation unit that calculates a driving signal for said high pressure fuel pump by using a proportional term and an integral term which are calculated with the use of a deviation between a target delivery pressure of said high pressure fuel pump and a detected value of said pressure sensor as a parameter;

a first processing unit that carries out decreasing processing for decreasing a delivery pressure of said low pressure fuel pump when an amount of change per unit time of said integral term is equal to or less than zero;

a second processing unit that carries out increasing processing for increasing the delivery pressure of said low pressure fuel pump when the amount of change per unit time of said integral term is larger than zero; and a prohibition unit that prohibits execution of the increasing processing by said second processing unit when the amount of change per unit time of said integral term becomes larger than zero due to a change in the target delivery pressure of said high pressure fuel pump.

2. The fuel injection control system for an internal combustion engine in claim 1, wherein said prohibition unit prohibits execution of the decreasing processing by said first processing unit when the amount of change per unit time of said integral term becomes equal to or less than zero due to a change in the target delivery pressure of said high pressure fuel pump.

* * * * *